US006824409B2

(12) United States Patent
Thiele et al.

(10) Patent No.: US 6,824,409 B2
(45) Date of Patent: Nov. 30, 2004

(54) HOLDER FOR LAMPS WITH A TWO-PIN CAP

(75) Inventors: Juergen Thiele, Kierspe (DE); Hans-Peter Mews, Luedenscheid (DE)

(73) Assignee: Vossloh-Schwabe Deutschland GmbH, Ludenscheid (DE)

( * ) Notice: Subject to any disclaimer, the term of this patent is extended or adjusted under 35 U.S.C. 154(b) by 72 days.

(21) Appl. No.: 10/125,528

(22) Filed: Apr. 19, 2002

(65) Prior Publication Data

US 2002/0155742 A1 Oct. 24, 2002

(30) Foreign Application Priority Data

Apr. 19, 2001 (DE) ..... 101 19 081

(51) Int. Cl.[7] ..... H01R 33/02

(52) U.S. Cl. ..... 439/242; 439/375; 439/182; 439/220

(58) Field of Search ..... 439/242, 226, 439/227, 228, 229, 236, 374, 375, 182, 56, 168, 220, 280, 883, 893, 602, 611, 619

(56) References Cited

U.S. PATENT DOCUMENTS 3,771,106 A * 11/1973 Matsumoto et al. ..... 439/23
4,804,343 A * 2/1989 Reedy ..... 439/854
5,709,450 A * 1/1998 Francis et al. ..... 362/546
5,746,615 A * 5/1998 Ichikawa et al. ..... 439/227
5,816,837 A 10/1998 Henrici et al.
6,254,252 B1 * 7/2001 Coushaine et al. ..... 362/226
6,332,796 B1 * 12/2001 Chen ..... 439/226

FOREIGN PATENT DOCUMENTS

| | | |
|---|---|---|
| DE | 823 467 C | 12/1951 |
| DE | 1 803 594 U | 1/1960 |
| DE | 27 08 426 C3 | 1/1981 |
| DE | 197 45 762 C1 | 8/1999 |
| DE | 199 17 682 A1 | 11/2000 |
| EP | 0 758 808 A2 | 6/1996 |

* cited by examiner

*Primary Examiner*—P. Austin Bradley
*Assistant Examiner*—Edwin A. Leon
(74) *Attorney, Agent, or Firm*—Foley & Lardner LLC

(57) ABSTRACT

A lamp holder is provided comprising a housing, a contact pin retainer arranged within the housing, a rotary member rotatably mounted in the housing, and a fastener for fastening the rotary member to the housing. The contact pin retainer is adapted to receive a lamp contact pin. The rotary member comprises an insertion slot, a front shield, and a slotted pivot section extending away from the front shield and into the housing. The fastener includes a retaining pin fixed to the housing and penetrates a bearing opening provided in an end section of the slotted pivot section.

25 Claims, 5 Drawing Sheets

HOLDER FOR LAMPS WITH A TWO-PIN CAP

CROSS-REFERENCE TO RELATED PATENT APPLICATIONS

This application claims the benefit of and priority to Germany Application 101 19 081.6, filed Apr. 19, 2001, which is incorporated by reference herein in its entirety.

BACKGROUND OF THE INVENTION

1. Field of the Invention

The invention relates to a holder for lamps, in particular, to fluorescent lamp holders.

2. Background of the Invention

Fluorescent lamps are often designed as straight tubes that bear a two-pin electrical contact (i.e., a two-pin cap) at both ends. In order to hold and make contact with such fluorescent lamps, special holders are provided and arranged opposite to one another at a distance approximately corresponding to the length of the fluorescent lamp.

Such a holder is disclosed, for example, in German reference DE 199 17 682 A1, which is incorporated by reference herein in its entirety. The lamp holder has a housing with an insertion slot for the lateral insertion of two lamp pins. A disk-shaped housing part is rotatably mounted on the front side of the housing, and is penetrated by the insertion slot. In addition, the housing is designed in two parts. The housing front part bears contact elements for making electrical contact with the two lamp pins, the rotatably mounted part and fastening elements for stationary mounting of the holder. The other housing part forms a base that is to be fastened separately on the front part. Provided for this purpose are plug-in opening connectors provided on the front part, and pins provided on the base that constitute a degree of outlay on production.

Contact lugs or contact springs that are removed from external access are situated directly under the rotatably mounted front part.

DE 2 708 426, which is incorporated by reference herein in its entirety, discloses a lamp holder with a rotary member for fluorescent lamps, the rotary member penetrating a housing. A tubular pivot that is laterally slotted is also provided. Such a pivot covers the contact springs when it is in the insertion position. The pivot is latched on the rear side of the holder with the aid of the holder housing. This holder is critical in relation to the mounting of the holder itself. The contact springs cannot be directly inserted into the housing from the front side or rear side. This mounting scheme is not conducive to efficient automation.

DE 197 45 762 C1, which is incorporated by reference herein in its entirety, discloses a fluorescent lamp bolder with a radial support of contact pins of the lamp. For this purpose, the housing part holding the rotary member is provided with a tubular shoulder that holds the pivot, extending into the housing, of the rotary member. The tubular shoulder is dimensioned such that the contact pins of the fluorescent lamp slide along its outer surface when it is rotated into the connecting position.

EP 758 808 A2, which is incorporated by reference herein in its entirety, discloses a fluorescent lamp holder with a rotary member that is held in the housing by two latching limbs. The rotary member has a slotted front section that runs flush in a housing opening in the front side of the housing, without overreaching the housing. From the rear side of the housing, two resilient limbs project into the interior of the rotary member and latch the latter approximately at the level of the front shield. This design is particularly unsuitable for fluorescent lamps with a relatively narrow pin spacing.

SUMMARY OF THE INVENTION

The present invention is directed at eliminating and/or reducing one or more of the problems set forth above, and other problems found within the prior art. It is therefore an object of the invention to create a holder for lamps with a pin cap, in particular fluorescent lamps, that is easy to fabricate and which is suitable for lamps with a relatively small pin spacing.

A holder according to an aspect of the invention has a rotary member with a pivot section extending into the housing. The rotary member is held on a wall of the housing, by mounting the front end section of the pivot section on the holder housing. Preferably, the rotary member is held on the rear wall of the housing. At least partially due to this particular fastening scheme, no substantial space is required for fastening on the outer side of the pivot section of the rotary member or in its interior. Preferably, the fastener is arranged such that is do not come into contact with the contact pins of the fluorescent lamp. In other words, the fastener is preferably arranged completely in an axial region that is not reached by the contact pins. For this purpose, the length of the insertion slot measured in the axial direction is preferably greater than the length of the contact pins of the fluorescent lamp, the fastener(s) being arranged outside this length. Measured from the front shield up to its end section serving the purpose of fastening, the pivot section, therefore, preferably has a length that is greater than the length of the contact pins.

At least partially due to the preferred length relationship, the pivot section can be of a substantially slim design without becoming too delicate. The outside diameter of the pivot is preferably somewhat smaller than the distance separating the connecting surfaces, pointing away from one another, of the connecting pins. The slot width is preferably at least as large as the diameter of the connecting pins. The difference between two sizes yields the permissible thickness of the limbs of the pivot section. By fastening the pivot solely at its front end face, the thickness of the limbs is sufficiently large.

The retaining pin for the rotor is preferably constructed on the rear wall of the housing. This allows the possibility of simple mounting, particularly when the retaining pin is designed as a latching pin. The rotor then need only be inserted into the housing opening and latched in the rear wall with the aid of appropriate pressure. It is also possible in this way to use the rotor for holding the housing part together, particularly when the disk-shaped front shield of the rotor overreaches the front wall of the housing.

In one preferred embodiment, the fastener is designed with little or no play. The latter is achieved in that the distance between the outer side of the front wall of the housing and a correspondingly orientated bearing surface of the retaining pin is somewhat greater than the distance measured between the complementary surfaces of the rotor. As a result, the fastener clamps the rotor with its front shield against the front wall of the housing.

A fastener with little or no play can also be achieved by providing the latching pin with conical surfaces that are assigned a conical region in the opening of the end section of the pivot, The conical surfaces effect axial prestressing of the rotor into the housing.

The conical sections permit an improved centering and a bearing of the rotor substantially without (or with substantially very little) axial play.

Latching elements that are arranged between the front shield and the front wall of the housing can serve to set latching moments and a moment of resistance that counteracts the rotation of the rotor. The resiliently designed latching noses can be part of the front wall and engage in depressions that are formed in the front shield of the rotor. Tolerance compensation and adaptation to desired braking moments can be undertaken by varying the height of the latching noses.

The holder described is relatively insensitive to manufacturing tolerances of the rotor, In particular, manufacturing tolerances that result in the insertion slot of the rotor widening away from the front end section are relatively harmless. If the rotor is inserted into the housing opening, the inner edge of the housing opening guides the pivot section on its outer lateral surface such that the section takes the desired shape and its limbs are held substantially parallel.

Another improvement can be found in the guidance of the rotor on the housing. Harmful influences of manufacturing tolerance on guidance of the rotor can be removed or reduced by providing a separate bearing or guide device that can be constructed between the front wall and the front shield. The guide device is preferably formed by an arcuate rib that is arranged concentrically with the axis of rotation of the rotor, and by a groove complementary thereto. The rib can be part of the front shield, while the groove can be incorporated in the front wall. Moreover, it is possible to accommodate, the groove in the front shield, while the rib is part of the front wall. The guide device acts as a radial bearing, and bears the halves of the front shield radially inward and radially outward.

According to one aspect of the present invention, a lamp holder is provided comprising a housing, a contact pin retainer arranged within the housing, a rotary member rotatably mounted in the housing, and a fastener for fastening the rotary member to the housing. The contact pin retainer is adapted to receive a lamp contact pin. The rotary member comprises an insertion slot, a front shield, and a slotted pivot section extending away from the front shield and into the housing. The fastener includes a retaining pin fixed to the housing and penetrates a bearing opening provided in an end section of the slotted pivot section.

According to yet another aspect of the present invention, a method of holding a lamp is provided comprising the steps of providing a lamp holder housing with a housing opening, inserting a rotary member into the housing opening, fastening the rotary member to the housing in such a way that the rotary member is locked in an axial direction and is rotatable about the axial direction, and coupling at least one electrical contact within the housing to at least one electrical contact on the lamp.

According to yet another aspect of the present invention, a lamp holder is provided comprising a multi piece housing including an upper housing part positioned adjacent to and above a lower housing part, electrical contacts provided within the upper housing, a rotary member including a pivot section protruding into an opening within the upper housing part and a facial portion positioned on a surface of the upper housing part opposite to the lower housing part, and a fastener for fastening the pivot section to the lower housing part. The lower housing part includes at least one guide for aligning the lower housing part to the upper housing part. The electrical contacts are adapted to engage corresponding pin contacts on a lamp. The fastener fastens the rotary member to the housing in such a way that the rotary member is locked in an axial direction and is rotatable about the axial direction.

BRIEF DESCRIPTION OF THE DRAWINGS

The foregoing advantages and features of the invention will become apparent on reference to the following detailed description and the accompanying drawings, of which.

DETAILED DESCRIPTION OF THE PREFERRED EMBODIMENTS

Reference will now be made in detail to presently preferred embodiments of the invention. Wherever possible, the same reference numbers will be used throughout the drawings to refer to the same or like parts.

Figure 1:
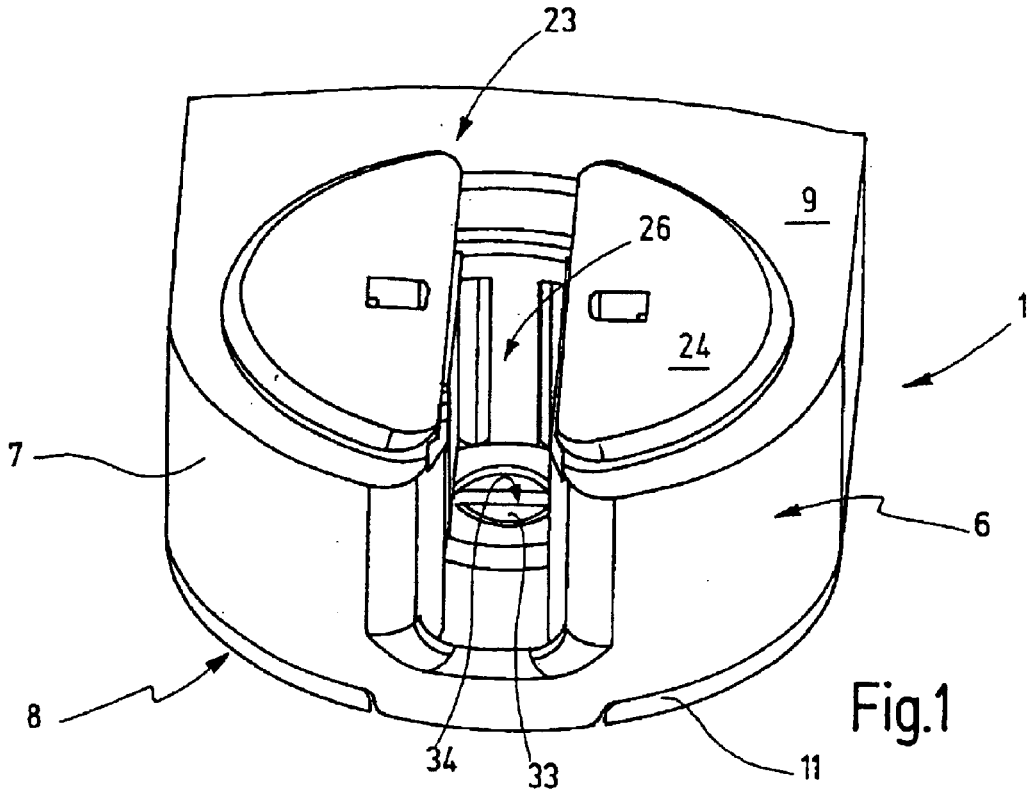
FIG. 1 shows a holder in a partial perspective representation according to the present invention.
Figure 3:
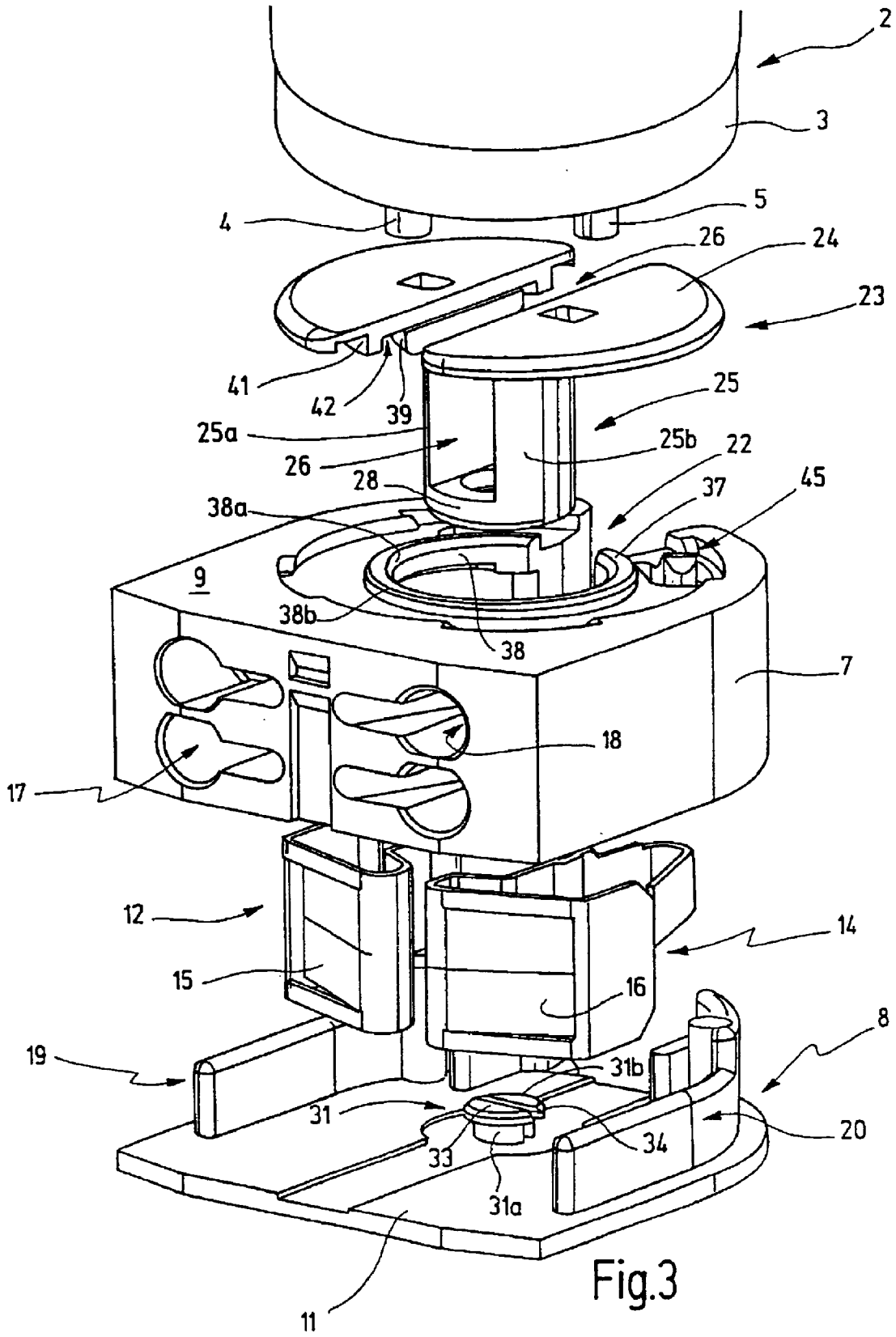
FIG. 3 shows the holder according to FIGS. 1 and 2 in an exploded representation according to the present invention.

FIG. 1 illustrates a holder 1 for a fluorescent lamp 2 (FIG. 3). The fluorescent lamp 2 has at one end a cap 3 with two contact pins 4, 5 that extend away from the cap 3 substantially parallel to and at a spacing from one another.

The holder 1 has a housing 6 to which a front housing part 7 and a rear housing part 8 belong. The front housing part 7 has a substantially plane front wall 9, while the lower housing part has a likewise plane rear wall 11. The housing parts 7, 8 enclose an interior in which there are arranged contact springs 12, 14 (FIG. 3). The springs 12, 14 are adapted to make electrical contact with the contact pins 4, 5 of the fluorescent lamp 2.

The housing parts 7, 8 have appropriate bearings in the form of projections, seating surfaces and the like in order to bear the contact springs 12, 14 in a stationary fashion. The contact springs 12, 14 are provided with at least one end respectively with at least one connecting means 15, 16 (FIG. 3) that is formed, for example, by a resilient contact tongue for the purpose of constructing a resilient plug-in contact. The connecting means 15, 16 are assigned plug-in openings 17, 18 (FIG. 3) that are provided in one of the housing parts 7, 8 and through which insulation-stripped line ends are to be pushed into the housing 6. In order to hold and correctly position the housing parts 7, 8 relative to one another, guide projections 19, 20 (FIG. 3), for example, are constructed on the rear wall 11, and are adapted to the inner contour of the housing part 7. The guide projections 19, 20 preferably grip in the interior thereof with little or no play, when the housing parts 7, 8 are assembled.

Figure 2:
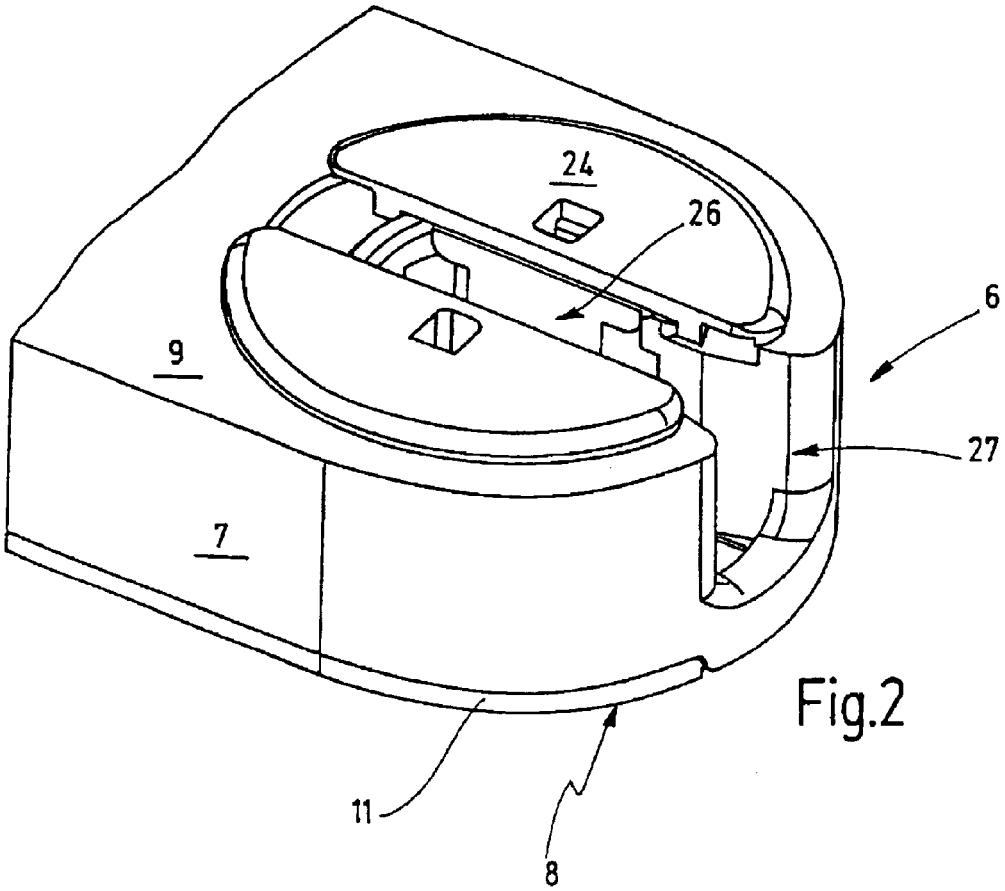
FIG. 2 shows the holder according to FIG. 1 in another perspective representation according to the present invention.
Figure 4:
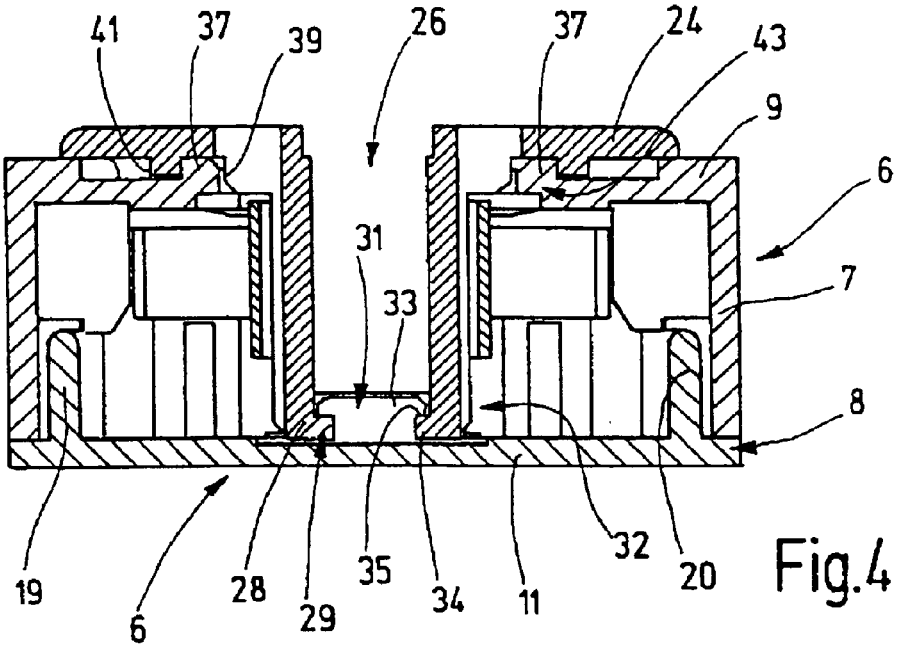
FIG. 4 shows a holder in a sectional representation according to the present invention.
Figure 5:
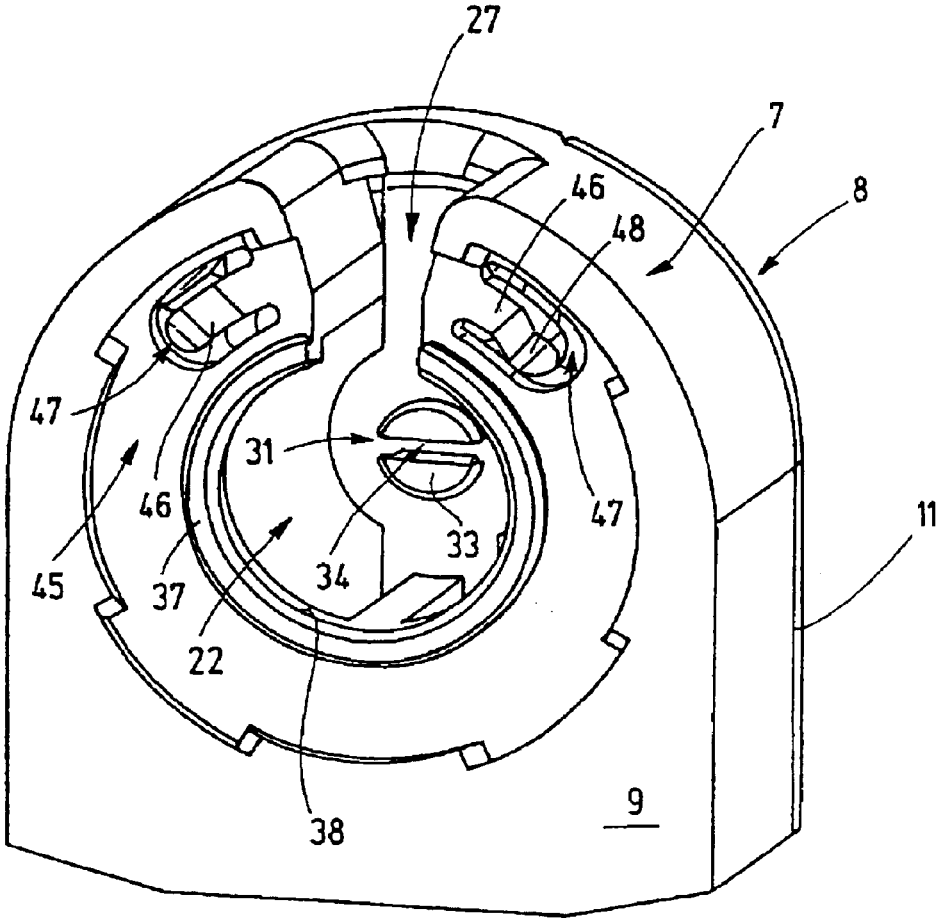
FIG. 5 shows a housing of the holder in a perspective representation according to the present invention.

The housing 6 has in its front wall 9 a housing opening 22 that holds a rotatable housing part (e.g., a rotary member 23 or rotor). The rotary member 23 has a disk-shaped front shield 24 that is of substantially plane construction on its outer side facing the lamp 2. On its rear side, it has a pivot section 25 that, as illustrated in FIG. 4, extends substantially up to the rear wall 11 in the mounted state. The front shield 24 and the pivot section 25 are penetrated by an insertion slot 26, whose width is somewhat greater than the diameter of each contact pin 4, 5, and extends substantially over the diameter of the front shield 24 (FIG. 1, FIG. 2). The insertion slot 26 continues through the outer edge of the upper housing part 7 and ends in an insertion opening 27 (FIG. 2). As illustrated in FIG. 5, the insertion opening 27 is of substantially funnel-shaped construction and ends in the housing opening 22.

The insertion slot 26 penetrates the pivot section 25 virtually completely. The pivot section 25 has, at its free front end, however, an end section 28 that connects the two halves 25*a*, 25*b* (limbs) of the pivot section 25 to one another, which are separated from the insertion slot 26. The end section 26 has a bearing opening 29 that is arranged coaxially with the pivot section 25, and whose free cross section is somewhat smaller than the width of the insertion slot 26. Together with a retaining pin 31 constructed on the housing part 8, the bearing opening 29 forms a fastener 32 (FIG. 4) for the rotary member 23.

As shown in FIGS. 3 and 4, the retaining pin 31 is preferably constructed on the rear wall 11. It has a head 33 whose diameter is greater than the free cross section of the bearing openings 29, but in this case smaller than the width of the insertion slot 26. These relationships are to be seen, in particular, from FIG. 4, which also illustrates the beveled (conical) edge of the head 33 and a funnel-shaped extension of the bearing openings 29. Further slot 34 is provided that penetrates the retaining pin 31 and its head 33 and subdivides the retaining pin 31 into resilient limbs 31*a*, 31*b*, the result is the creation of a latch that permits the rotary member 23 to be connected in a latched fashion to the housing part 8.

Figure 7:
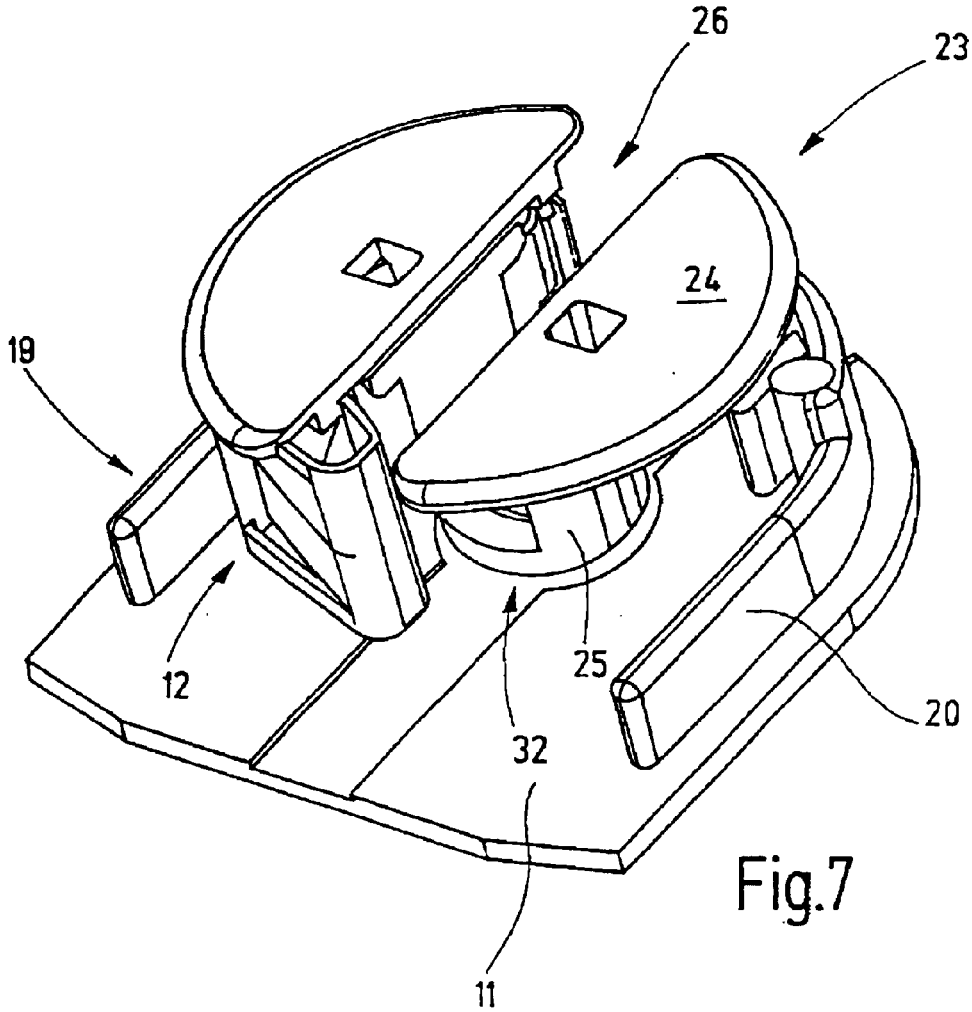
FIG. 7 shows a rear wall of the housing with rotor, in the perspective representation according to the present invention.

The head 33 has on its side facing the rear wall 11, an annular surface 35 that serves as seating surface for the end section 28. The position of the annular surface 35 and the end section 28 are dimensioned, in this case, such that both bear against one another under pre-stress when the rotary member 23 is seated in the closed housing 6, and its front shield 24 bears against the front wall 9. In addition, the fastener 32 forms an axially fixed, but still rotatable bearing, for the rotary member 23 on its rear housing part 8. As may be seen from FIG. 7, the rear wall 11, therefore, serves both for bearing the rotary member 23 (via fastener 32) and for bearing the contact springs 12, 14 (only spring 12 is illustrated in FIG. 7). This configuration results in particularly good precision in the spatial assignment of the rotary member 23 and contact springs 12, 14, and thus provides for a reliable contact with the lamp 2.

As seen in FIGS. 2–5, the rotary member 23 is guided or born radially on both sides of its pivot section 25. This purpose is served at the front end by the fastener 32. At the opposite end of the pivot section 25, the bearing is effected by an annular arcuate rib 37 that is arranged, for example, directly at the edge of the housing opening 22. The inner circumferential surface 38 of the rib 37 serves, for example, as a bearing surface for a corresponding annular shoulder 39 that surrounds the pivot section 25 in the immediate vicinity of the front shield 24.

A rib 41 interrupted twice by the insertion slot 26 is provided at some distance from the shoulder 39 on the rear side, facing the front wall 9, of the front shield 24. With the shoulder 39, the rib 41 delimits an annular groove 42 for holding the rib 37. The rib 37 and the annular groove 42 jointly form a bearing 43 with the aid of which the front shield 24 is rotatabty mounted on the front housing part 7. In this case, the two halves of the shield 24, which are separated from one another by the insertion slot 26, are held, independently of the manufacturing tolerances of the rotary member 23, at a distance from one another such that the insertion slot 26 has its required width, but also does not substantially exceed it. The dimensional stability of the rotary member 23 is not, therefore, a function of the stiffness of the slotted pivot section 25, but is primarily determined by the housing 6.

Figure 6:
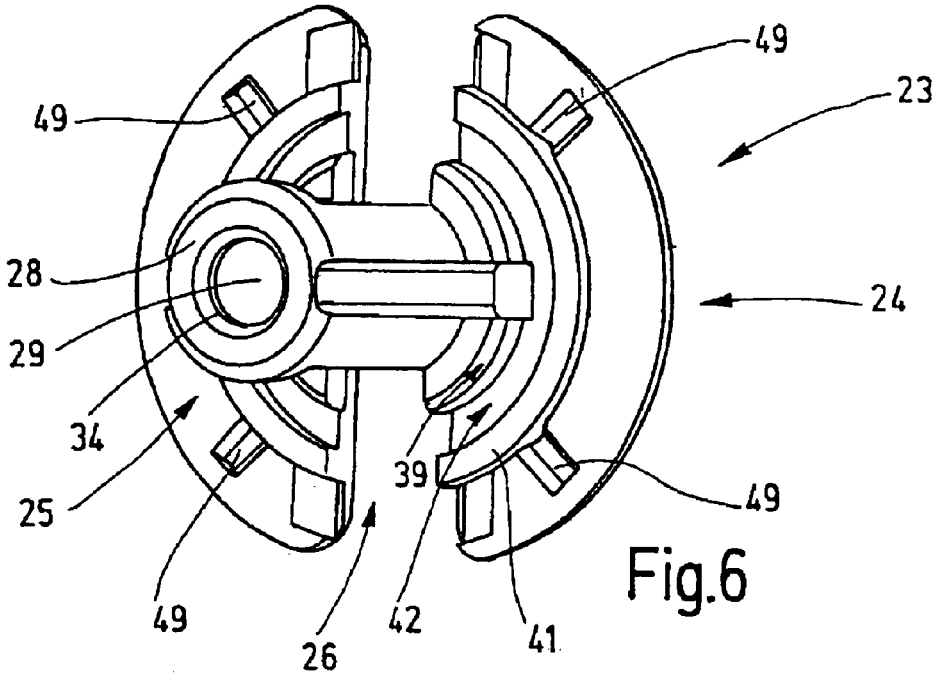
FIG. 6 shows a rotor of the holder in a perspective representation according to the present invention.

The rotary member 23 is held in preferred rotational positions (FIGS. 5 and 6) by latch 45. The latch 45 includes latching tongues 46 that are cut out by a substantially U-shaped slot 47 in the front wall 9 in a region covered by the shield 24. The latching tongues 46 are connected with one end to the front wall 9. Opposite ends of the latching tongues 46 bear a latching nose 48 that is provided in each case with a sloping surface in two circumferential directions.

The latching noses 48 are assigned depressions 49 (FIG. 6) formed in the shield 24 on the side facing the front wall 9. The depressions 49 are preferably arranged in this case in an angular spacing of about 90°. The same holds for the latching noses 48. Consequently, a total of four stable latching positions are yielded at a mutual angular spacing of 90°. If required, instead of the two latching tongues 46 illustrated in FIG. 5, it is also possible to provide a total of four latching tongues, in order to enhance the latching action. These are then arranged at mutual spacings of 90°. Moreover, it is possible to arrange one or more latching tongues outside the 90° array, in order to fix further latching positions. It is possible as a further alternative to provide only a single latching tongue when the latching action is rather intended to be weakly expressed. Other configurations may also be possible, as would be readily apparent to one of ordinary skill in the art after reading this disclosure.

For mounting purposes, the housing 6 is assembled with the contact springs 12, 14 located therein, and the rotary member 23 is inserted into the housing opening 22. In this process, its bearing opening 29 latches relatively tight over the head 33 of the retaining pin 31. Moreover, in this operation the rib 37 comes into the annular groove 42. For this purpose, the rib 37 respectively has conical guide surfaces 38*a*, 38*b* on its inner side and its outer side (FIG. 3). This compensates for manufacturing tolerances that can be seen in that the limb halves 25*a*, 25*b* that are not aligned parallel to one another.

The rotary member 23 is guided or born in the radial direction at both axial ends. This purpose is served by the fastener 32 and the guide or bearing 43 (FIG. 4). The rotor 23 holds the housing parts 7 or 8 together and in doing so remains so stable, owing to the guidance at both ends, that it is suitable in the relatively small designs for lamps 2 with a pin spacing of, for example, only 4.75 mm with relatively large pin diameters of 2.67 mm. This is at least partially due to a substantial lack of fastener within the interior of the rotary member 23.

A holder for lamps with a pin cap has a rotary member 23 that is held in the housing 6 of the holder 1 at the end of its pivot section 25. The purpose is served by a fastener 32 that effects axial locking 33 of the rotary member 23 and a rotatable bearing of the same. In a supplementary fashion, a bearing 43 that is constructed as a guide device can be arranged under the front shield 24 of the rotary member 23. The bearing 43 is formed by a rib 37 or other projections that engage in a corresponding annular groove 42 in the rotary member 23 and thus bear its halves, separated by the insertion slot 26, in the radial direction. The arrangement can also be reversed—projections of the front shield 24 can engage in a corresponding annular groove in the front wall 9.

Figure 8:
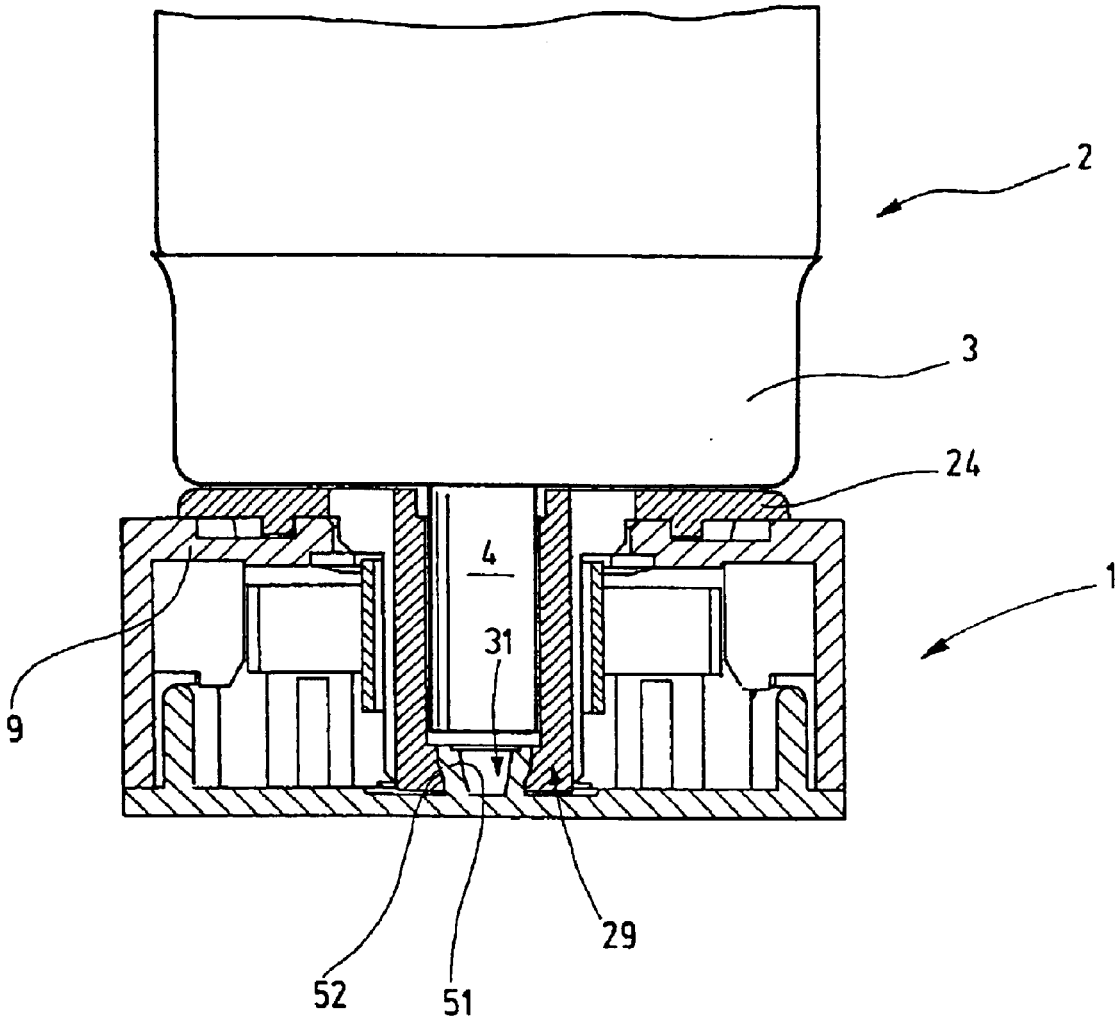
FIG. 8 shows another holder in a sectional representation according to the present invention.

Another embodiment of the invention is illustrated in FIG. 8. In a departure from the previously described embodiment, the bearing pin 31 does not have a disk-shaped head, but rather a conical outer bearing surface 51. The latter is assigned a conical surface 52 provided in the bearing openings 29. The conical surfaces 52 effect an axial pull of the rotary member 23 into the housing opening 22 in conjunction with an outwardly directed radial clamping of the bearing pin 31. The front shield 24 is thereby pulled onto the front wall 9. The bearing pin 31 can be produced from the start in the shape illustrated, cylindrically, or produced in other shapes as would be readily apparent to one of ordinary skill in the art after reading this disclosure. In the case of a cylindrical shape, it obtains its shape by plastic or thermal expansion after insertion of the rotor 23.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined the claims appended hereto, and their equivalents.

What is claimed:

1. A lamp holder, comprising:

a housing;

a contact pin retainer arranged within said housing, said contact pin retainer being adapted to receive a lamp contact pin;

a rotary member rotatably mounted in said housing, said rotary member comprising:

an insertion slot;

a front shield; and a slotted pivot section extending away from said front shield and into said housing; and a fastener for fastening said rotary member to said housing, said fastener including a retaining pin fixed to said housing and penetrating a bearing opening provided in an end section of said slotted pivot section; wherein the insertion slot is provided in the slotted pivot section, and wherein the slot has a cross-section that is longer in length than in width, the cross-section being taken in a plane normal to the direction of extension away from said front shield.

2. The holder as claimed in claim 1, wherein the housing has a rear wall on which the retaining pin is constructed.

3. The holder as claimed in claim 1, wherein the retaining pin comprises a latching pin.

4. The holder as claimed in claim 1, wherein the retaining pin comprises at least two limbs that are resiliently prestressed away from one another and are provided with conical surfaces on their outer side, and wherein the bearing opening of the end section has at least one conical region adapted to receive the conical surfaces.

5. The holder as claimed in claim 1, wherein the fastener does not substantially penetrate into an interior portion of the rotary member.

6. The holder as claimed in claim 1, wherein the end section of the slotted pivot section is the same end section as the rotary member, and wherein the retaining pin has a head, and only the head extends into the slotted pivot section.

7. The holder as claimed in claim 1, wherein the retaining pin has a head, and only the head extends into the rotary member.

8. The holder as claimed in claim 1, wherein the insertion slot traverses the rotary member.

9. The holder as claimed in claim 1, wherein the bearing opening is a circular bearing opening and is located adjacent to the insertion slot, and wherein the insertion slot traverses the rotary member.

10. The holder as claimed in claim 1, wherein the front shield rests on a front wall of the housing.

11. The holder as claimed in claim 10, further comprising at least one latch positioned on said holder and between the front shield and the front wall.

12. The holder as claimed in claim 11, wherein said at least one latch includes a corresponding number of latching tongues constructed on the front wall, and wherein a corresponding number of cutouts are formed in the front shield, each of said cutouts being adapted to receive a corresponding latch.

13. The holder as claimed in claim 10, wherein a guide device is constructed between the front wall and the front shield.

14. The holder as claimed in claim 13, wherein the guide device comprises an arcuate rib and an arcuate groove constructed on the front shield and the front wall respectively.

15. The holder as claimed in claim 1, wherein the housing is designed in two parts.

16. The holder as claimed in claim 15, wherein one housing part includes a rear wall, and another housing part includes a front wall, and wherein the rotary member secures the two housing parts to one another.

17. A lamp holder, comprising:

a multi-piece housing including an upper housing part positioned adjacent to and above a lower housing part, said lower housing part including at least one guide for aligning said lower housing part to said upper housing part;

electrical contacts provided within the upper housing, said electrical contacts being adapted to engage corresponding pin contacts on a lamp;

a rotary member including a pivot section protruding into an opening within said upper housing part and a facial portion positioned on a surface of said upper housing part opposite to said lower housing part; and a fastener for fastening the pivot section to the lower housing part, said fastener fastening the rotary member to the housing in such a way that the rotary member is locked in an axial direction and is rotatable about the axial direction.

18. The lamp holder of claim 17, wherein the fastener does not substantially penetrate into an interior portion of said pivot section.

19. The lamp holder of claim 17, further comprising a latching device for latching the rotary member in one of a plurality of latching locations.

20. The lamp holder of claim 17, wherein the fastener fastens the pivot section to the lower housing part with no substantial play in the axial direction.

21. The holder as claimed in claim 1, wherein the insertion slot is provided in the slotted pivot section, and wherein the slot has a cross-section that is substantially longer in length than in width, the cross-section being taken in a plane normal to the direction of extension away from said front shield.

22. The holder as claimed in claim 1, wherein the insertion slot is adapted to receive a lamp contact pin.

23. The lamp holder as claimed in claim 17, wherein an insertion slot is provided in the pivot section, and wherein the slot has a cross-section that is substantially longer in length than in width, the cross-section being taken in a plane normal to the axial direction.

24. The holder as claimed in claim 1, wherein the insertion slot is adapted to receive a plurality of lamp contact pins.

25. The holder as claimed in claim 24, wherein the insertion slot spans the front shield.

* * * * *